US009874194B2

(12) United States Patent
Skowronek et al.

(10) Patent No.: US 9,874,194 B2
(45) Date of Patent: Jan. 23, 2018

(54) IGNITION SYSTEM AND METHOD FOR OPERATING AN IGNITION SYSTEM

(71) Applicant: Robert Bosch GmbH, Stuttgart (DE)

(72) Inventors: Tim Skowronek, Missen-Wilhams (DE); Thomas Pawlak, Immenstadt (DE); Wolfgang Sinz, Hergatz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/036,360

(22) PCT Filed: Oct. 16, 2014

(86) PCT No.: PCT/EP2014/072208

§ 371 (c)(1),
(2) Date: May 12, 2016

(87) PCT Pub. No.: WO2015/071044

PCT Pub. Date: May 21, 2015

(65) Prior Publication Data

US 2016/0298591 A1 Oct. 13, 2016

(30) Foreign Application Priority Data

Nov. 14, 2013 (DE) ..... 10 2013 223 193
Aug. 13, 2014 (DE) ..... 10 2014 216 044

(51) Int. Cl.
*F02P 9/00* (2006.01)
*F02P 3/04* (2006.01)
*F02P 15/10* (2006.01)

(52) U.S. Cl.
CPC ..... *F02P 9/007* (2013.01); *F02P 3/04* (2013.01); *F02P 15/10* (2013.01)

(58) Field of Classification Search
CPC ..... F02P 9/007; F02P 3/04; F02P 15/10
See application file for complete search history.

(56) References Cited

U.S. PATENT DOCUMENTS 2,117,422 A * 5/1938 Holthouse ..... F02P 9/002 315/220
5,456,241 A * 10/1995 Ward ..... F02P 3/0892 123/169 EL (Continued)

FOREIGN PATENT DOCUMENTS

CN 103306878 A 9/2013
DE 102011089966 A1 6/2013

(Continued)

OTHER PUBLICATIONS

International Search Report dated Jan. 22, 2015, of the corresponding International Application PCT/EP2014/072208 filed Oct. 16, 2014.

*Primary Examiner* — Joseph Dallo
(74) *Attorney, Agent, or Firm* — Norton Rose Fulbright US LLP; Gerard Messina

(57) ABSTRACT

A method is described for operating an ignition system for an internal combustion engine, including a primary voltage generator and a bypass, in particular, a boost converter for maintaining a spark generated with the aid of the primary voltage generator, the method includes an ascertainment of a modified energy requirement for an ignition spark, which is to be maintained with the aid of the bypass and a modification of the working mode of the bypass in response thereto.

18 Claims, 3 Drawing Sheets

(56) References Cited

U.S. PATENT DOCUMENTS

| | | | | |
|---|---|---|---|---|
| 6,196,054 | B1 * | 3/2001 | Okamura | F02D 35/021 123/406.29 |
| 6,205,844 | B1 * | 3/2001 | Morita | F02D 35/027 73/35.08 |
| 6,779,517 | B2 * | 8/2004 | Sakakura | F02P 3/051 123/630 |
| 7,347,195 | B2 * | 3/2008 | Biljenga | F02P 9/007 123/620 |
| 9,353,723 | B2 * | 5/2016 | Bengtsson | F02P 3/0807 |
| 9,397,483 | B2 * | 7/2016 | Muramoto | H01T 15/00 |
| 2005/0279337 | A1 * | 12/2005 | Biljenga | F02P 9/007 123/620 |
| 2014/0116405 | A1 * | 5/2014 | Tanaya | F02P 3/02 123/634 |
| 2015/0008838 | A1 | 1/2015 | Reuther et al. | |
| 2016/0164263 | A1 * | 6/2016 | Muramoto | H01T 15/00 315/279 |

FOREIGN PATENT DOCUMENTS

| | | | |
|---|---|---|---|
| EP | 1609986 | | 12/2005 |
| EP | 2325476 | A1 | 5/2011 |
| JP | S60178967 | A | 9/1985 |
| JP | H05164028 | | 6/1993 |
| JP | H07174063 | | 7/1995 |
| WO | WO 2013/077011 | | 5/2013 |

* cited by examiner

IGNITION SYSTEM AND METHOD FOR OPERATING AN IGNITION SYSTEM

FIELD

The present invention relates to a method for operating an ignition system for an internal combustion engine, including a primary voltage generator and a bypass. The present invention relates, in particular, to a reduction of the wear within the ignition system during operation.

BACKGROUND INFORMATION

Ignition systems are used in order to ignite an ignitable mixture in a combustion chamber of a spark ignited internal combustion engine. For this purpose, an ignition spark gap is acted on with a voltage, in response to which the forming ignition spark ignites the combustible mixture in the combustion chamber. The main requirements of modern ignition systems are an indirect result of required emissions and fuel reductions. Requirements of ignition systems are derived from corresponding engine-related approaches, such as supercharging and lean burn operation and shift operation (spray-guided direct injection) in combination with increased exhaust gas recirculation rates (EGR). The representation of increased ignition voltage requirements and energy requirements in conjunction with increased temperature requirements is necessary. In conventional inductive ignition systems, the entire energy required for ignition must be temporarily stored in the ignition coil. The stringent requirements with respect to ignition spark energy result in a large ignition coil design. This conflicts with the requirements for smaller installation spaces of modern engine concepts ("downsizing"). In an earlier application, two main functions of the ignition system were assumed by different assembly units. A high voltage generator generates the high voltage necessary for the high voltage spark-over at the spark plug. A bypass, for example, in the form of a boost converter, provides energy for maintaining the ignition spark for continued mixture ignition. In this way, high spark energies may be provided at an optimized spark current profile despite a smaller ignition system design.

High spark currents are known to result in severe erosion of the spark plug electrodes, whereas low spark currents may result in a spark breakaway in the event the ignition spark energy falls below a defined limit. Conventional systems do not satisfactorily exhaust the potential for wear reduction in ignition systems.

SUMMARY

In accordance with the present invention, spark energy is provided according to demand so that the spark current may be set to a desired value. Thus, the working mode of the bypass is modified as a function of the energy requirement of the ignition spark. In this way, a compromise may be achieved in a suitable manner between electrode erosion and the tendency toward spark breakaway. The example method according to the present invention for operating an ignition system is particularly suited, for example, for a gasoline-operated internal combustion engine. The ignition system includes a primary voltage generator and a bypass, designed, in particular, as a boost converter, the bypass being configured to maintain a spark generated with the aid of the primary voltage generator. Via the bypass, it is possible to bring vehicle electrical system energy to a suitable voltage level and to guide it to the spark gap. The method according to the present invention is distinguished by ascertaining a modified energy requirement for an ignition spark to be maintained with the aid of the bypass. In other words, the energy requirement for the ignition spark may vary as a function of an instantaneous operating state and such a variation may be ascertained according to the present invention. In response thereto, the working mode of the bypass is modified in order to dose the ignition spark energy according to need. In this way, the spark plug wear is reduced through the avoidance of high spark currents. A particularly severe electrode wear occurs in commercially available spark plugs, for example, at spark currents greater than 100 mA. In addition, a spark breakaway resulting from the increase in the power output of the bypass is avoided by adjusting the working mode of the bypass when a lower spark current threshold value is undercut. Alternatively, the working mode of the bypass is adjusted when a voltage threshold value (measuring voltage) correspondingly related to the voltage value at the spark plug, is exceeded or undercut. The reduction of heat loss in the bypass by adjusting the spark current to a minimally required value is also an advantage of the present invention. The load of the electrical components (for example, of a high voltage capacitor for intermediate storage of electrical energy) is reduced. The electrical components may therefore be selected more cost effectively when designing the ignition system. In the electrical (control) circuitry as well, less heat loss is generated when the working mode of the bypass is adjusted to a modified energy requirement. On the whole, the present invention allows for a lower energy consumption of the ignition system from the vehicle electrical system (for example, of a motor vehicle or a passenger vehicle), as a result of which cable cross sections may be smaller dimensioned and consumption advantages may be achieved. Moreover, lower currents within the ignition system mean a reduction of electromagnetic emissions. In other words, the electromagnetic compatibility (EMC) is improved.

The ascertainment of the modified energy requirement preferably includes a measurement of an ignition spark current or an ignition spark voltage, or a corresponding measuring voltage. This may take place using a shunt, for example, via which a current through the ignition spark gap of the ignition system is ascertained. The voltage may be ascertained, for example, with the aid of an electrical control or an analog electrical circuit, for example, in the form of a microcontroller, a field programmable gate array (FPGA) or an ASIC within the ignition system. This requires fewer or no additional hardware outlays for implementing the method according to the present invention.

The ascertainment of the modified energy requirement also preferably includes a comparison of a measured electrical parameter of an ignition spark with an assigned reference. The reference may, for example, be retrieved from a memory medium. This reference characterizes threshold values, for example, during the exceeding of which the ignition spark energy should be lowered to avoid erosion and during the undercutting of which the ignition spark energy should be increased to avoid an undesirable spark breakaway. For example, threshold values representing ignition spark currents and/or ignition spark voltages may be saved as electrical parameters and compared with ascertained parameters. The comparison with individual threshold values represents a simple mathematical operation which, in terms of circuitry, is implementable in a cost effective and space-saving manner.

The method further preferably includes the step of classifying the electrical parameter by assigning a measured value for the electrical parameter to a predefined parameter interval, for example, within a storage medium of the ignition system. In this case, the ignition system may be configured to assign suitable operating parameters of the bypass to respective parameter classes. The parameters may be assigned, for example, within a memory medium of the ignition system of the respective parameter class and, in response to a classification, may be used to operate the bypass. This operation is also a low-cost and, in terms of circuitry, simple and rapidly achievable option for implementing the present invention.

It may be very advantageous if the modified energy requirement is ascertained by ascertaining in a first step an electrical parameter and/or a change in this parameter and/or a change speed of this parameter. The electrical parameter is, for example, a current of the ignition spark and/or a voltage characterizing a voltage of the ignition spark. In a second step, it is ascertained whether an exceedance condition and/or undercut condition is met, by ascertaining whether a comparison variable exceeds a predetermined upper threshold value and/or undercuts a predetermined lower threshold value. The comparison variable in this case may be the ascertained parameter or the change of the ascertained parameter or the change speed of the ascertained parameter. The working mode of the bypass is modified according to the exemplary embodiment by reducing the power output or a variable characterizing the power output when the exceedance condition is met. If, in contrast, the undercut condition is met, a spark breakaway is imminent and the power output or the variable characterizing the power output is increased. In this way, the spark current is adjusted to a value so that neither a spark breakaway is imminent, nor a strong erosion of the spark plug electrode occurs.

The parameter is further preferably ascertained within an electrical control, an electronic circuit, for example, in the form of a microcontroller, an FPGA and/or an ASIC of the ignition system. The aforementioned electronic components are situated, for example, in the area of the ignition system for controlling the ignition process. Therefore, an implementation of the present invention is possible in this way without additional hardware outlays.

The modification of the working mode of the bypass further preferably includes an increase of a current output and/or voltage output and/or a power output of the bypass. This is, in particular, the case if it is ascertained that a previous current output/a previous voltage output/a previous power output resulted in an electrical parameter of the ignition spark, which undercuts a predetermined reference (a threshold value). In the reverse case, the modification of the working mode of the bypass may also include a reduction of a current output and/or a voltage output and/or a power output of the bypass, in order to lower an instantaneous electrical parameter of the ignition spark to a value below a reference (a threshold value). In this way, it is possible to effectively avoid or reduce both a spark erosion as well as a breakaway of the ignition spark.

The modification of the working mode of the bypass may also include a lengthening or a shortening of an electrical signal output for maintaining the ignition spark. For example, a supply of electrical energy through the bypass may be shortened or lengthened in response to a modified operating state (for example, a modified speed), in order to adjust modified engine speeds and, accordingly, also the ignition spark duration. In addition, it is possible to ascertain via pressure sensors and/or torque sensors that a mixture in the combustion chamber was not successfully ignited, so that maintaining the ignition spark appears appropriate. This embodiment offers additional degrees of freedom during ignition as a result of a method according to the present invention.

The example ignition system designed for an internal combustion engine, with the aid of which the example method according to the present invention is carried out, includes a bypass for maintaining a spark generated with the aid of a primary voltage generator. The bypass may be designed, for example, as a boost converter. The ignition system includes an element for ascertaining a modified energy requirement for an ignition spark to be maintained with the aid of the bypass. In other words, the element is able to ascertain a modification of the operating state of the ignition system or of the internal combustion engine, in response to which the spark plug must be supplied with a modified electrical energy or a modified electrical output, in order to avoid a spark breakaway on the one hand, and an excessive wear of the ignition system on the other hand. The ignition system also includes an element modifying the working mode of the bypass in response to an ascertained energy requirement change. This element is configured to adjust the energy supply through the bypass in accordance with the modified energy requirement in order to feed a modified output to the spark gap. For example, the ignition system includes a shunt, with the aid of which it is configured to carry out an ignition spark current measurement in order to ascertain a modified energy requirement. The voltage measurement via the shunt may take place, for example, with the aid of an electrical control or an analog electrical circuit, for example, in the form of a microcontroller, an FPGA and/or an ASIC of the ignition system. In addition, an ignition spark voltage also ascertained without the use of a shunt may be used by the aforementioned integrated circuits for ascertaining a changed energy requirement of the ignition spark gap. Here, too, currents, voltages and/or outputs may be included as electrical parameters to be ascertained. The ignition system may include an FPGA or an ASIC, in particular, one such system at every combustion chamber or at every spark plug.

For example, the ignition system also includes memory media, with the aid of which it is configured to classify the instantaneous energy requirement. In other words, the energy requirement measured in the instantaneous operating state may be compared to energy requirement classes within the memory media. In addition, the memory media may hold operating parameters in store for the bypass, which have proven suitable for the respective energy requirement classes.

BRIEF DESCRIPTION OF THE DRAWINGS

Exemplary embodiments of the present invention are described in detail below with reference to the figures.

DETAILED DESCRIPTION OF EXAMPLE EMBODIMENTS

Figure 1:
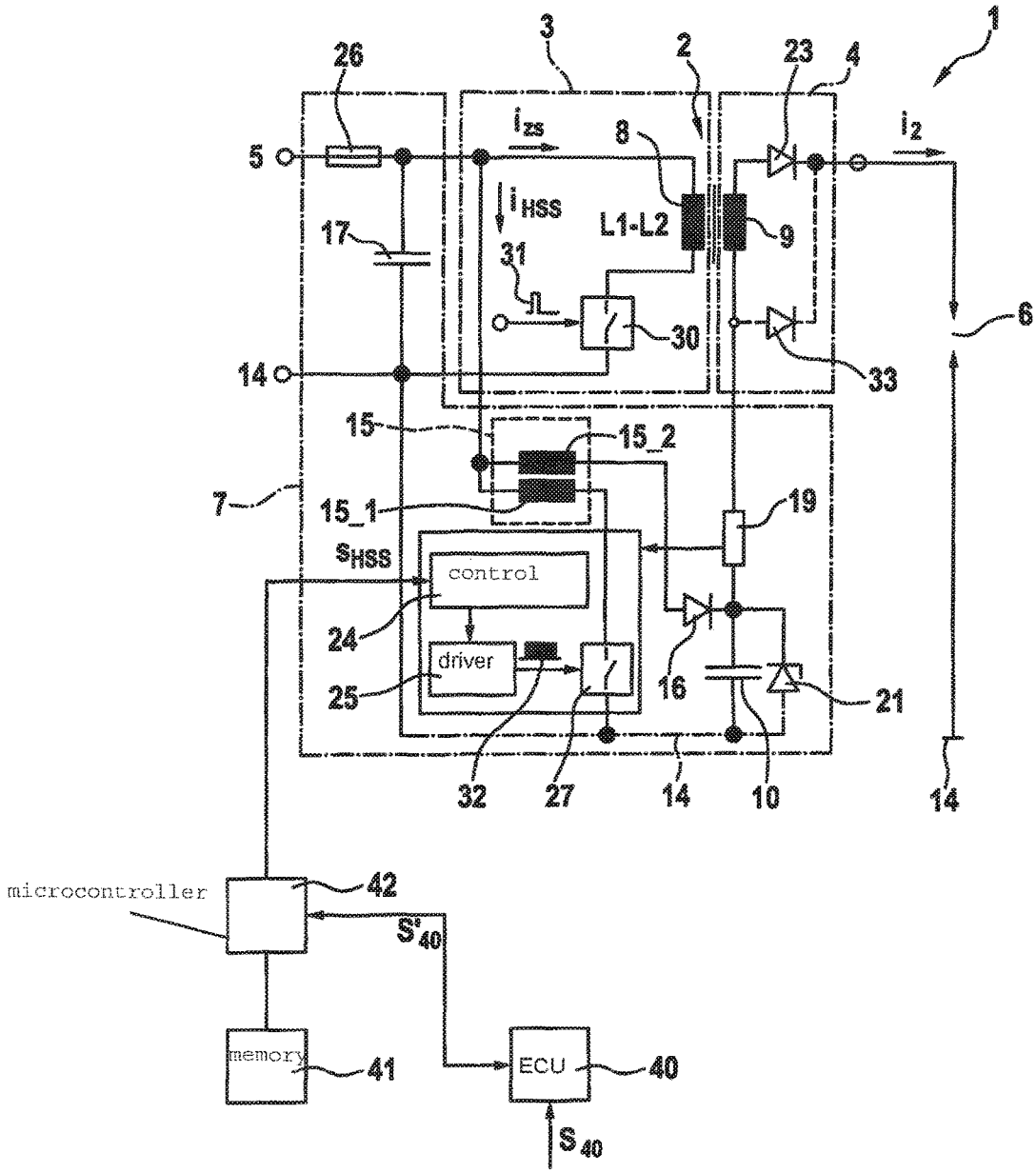
FIG. 1 shows a circuit diagram of one exemplary embodiment of an ignition system in which an example method according to the present invention may be used.

FIG. 1 shows a circuit of an ignition system 1, which includes a step-up transformer 2 as a high voltage generator, the primary side 3 of which may be supplied with electrical energy from an electrical energy source 5 via a first switch 30. Step-up transformer 2, made up of a primary coil 8 and a secondary coil 9, may also be referred to as a first voltage generator or primary voltage generator. A fuse 26 is provided at the input of the circuit, in other words, therefore, at the connection with electrical energy source 5. In addition, a capacitance 17 for stabilizing the input voltage is provided in parallel to the input of the circuit or in parallel to electrical energy source 5. Secondary side 4 of step-up transformer 2 is supplied with electrical energy via an inductive coupling of primary coil 8 and secondary coil 9, and includes a diode 23 known from the related art for suppressing the powering spark, this diode being alternatively substitutable with a diode 21. A spark gap 6, via which ignition current $i_2$ is intended to ignite the combustible gas mixture, is provide in a loop with secondary coil 9 and diode 23 against an electrical ground 14.

A bypass 7, which includes, for example, the electronic component parts of a boost converter, namely an inductance 15, a switch 27, a capacitance 10 and a diode 16, is provided between electrical energy source 5 and secondary side 4 of step-up transformer 2. In this bypass 7, inductance 15 is provided in the form of a transformer having a primary side 15_1 and a secondary side 15_2. Inductance 15 in this case serves as an energy store for maintaining a current flow. Two first terminals of primary side 15_1 and secondary side 15_2 of the transformer are each connected to electrical energy source 5 and fuse 26. In this configuration, a second terminal of primary side 15_1 is connected via switch 27 to electrical ground 14. A second terminal of secondary side 15_2 of the transformer is connected without a switch directly to diode 16 which, in turn, is connected via a node to a terminal of capacitance 10. This terminal of capacitance 10 is connected, for example, via a shunt 19 to secondary coil 9 and another terminal of capacitance 10 is connected to electrical ground 14. The power output of the boost converter is fed via the node at diode 16 into the ignition system and provided to spark gap 6.

Diode 16 is oriented conductively in the direction of capacitance 10. The structure of the bypass 7 is therefore comparable to a boost converter. Due to the transfer ratio, a switching operation by switch 27 in the branch of primary side 15_1 also acts on secondary side 15_2. However, since current and voltage according to the transformation ratio are higher or lower on the one side than on the other side of the transformer, more favorable dimensionings for switch 27 for switching operations may be found. For example, lower switching voltages may be implemented, as a result of which the dimensioning of switch 27 is potentially simpler and more cost-effective. Switch 27 is controlled via a control 24, which is connected via a driver 25 to switch 27. Shunt 19 is provided as a current measuring element or voltage measuring element between capacitance 10 and secondary coil 9, the measuring signal of which is fed to switch 27. In this way, switch 27 is configured to react to a defined range of current intensity $i_2$ through secondary coil 9. A Zener diode 21 is connected in the reverse direction in parallel to capacitance 10 for securing capacitance 10. Furthermore, control 24 receives a control signal $S_{HSS}$. Via this signal, the feed of energy or power output via bypass 7 into the secondary side may be switched on and off. In the process, the output of the electrical variable introduced by the bypass and into the spark gap, in particular via the frequency and/or pulse-pause ratio, may also be controlled via a suitable control signal $S_{HSS}$. A switching signal 32 is also indicated, with the aid of which switch 27 may be activated via driver 25. When switch 27 is closed, inductance 15 is supplied with current via electrical energy source 5, which flows directly to electrical ground 14 when switch 27 is closed. When switch 27 is open, the current is directed through inductance 15 via diode 16 to capacitor 10. The voltage occurring in response to the current in capacitor 10 is added to the voltage dropping across second coil 9 of step-up transformer 2, thereby supporting the electric arc at spark gap 6. In the process, however, capacitor 10 is discharged, so that by closing switch 27, energy may be brought into the magnetic field of inductance 15, in order to charge capacitor 10 with this energy again when switch 27 is re-opened. It is apparent that control 31 of switch 30 provided in primary side 3 is kept significantly shorter than is the case with switching signal 32 for switch 27. Optionally, a non-linear two-terminal circuit, symbolized by a high voltage diode 33 depicted with dashed lines, of coil 9 of the boost converter on the secondary side, may be connected in parallel. This high voltage diode 33 bridges high voltage generator 2 on the secondary side, as a result of which the energy or power output delivered through bypass 7 is guided directly to spark gap 6, without being guided through secondary coil 9 of high voltage generator 2. No losses across secondary coil 9 occur as a result and the degree of efficiency is increased.

An ascertainment according to the present invention of a modified energy requirement for the spark gap is possible through an information technology linking of engine control unit 40, which receives a first signal $S_{40}$ for setting an operating point of an internal combustion engine and outputs a corresponding second signal $S_{40}'$ to a microcontroller 42. Microcontroller 42 is further connected to a memory 41, from which references in the form of limiting values for classes of energy for the instantaneous or future required electrical energy for maintaining the spark gap may be read. Microcontroller 42 is configured to influence the working mode of bypass 7, to supply control 24 with a control signal $S_{HSS}$ modified according to need, in response to which driver 25 supplies switch 27 with a modified switching signal 32. For example, bypass 7 may supply spark gap 6 with more or less electrical energy in the form of an increased or decreased voltage output in response to the receipt of changed switching signal 32.

Figure 2:
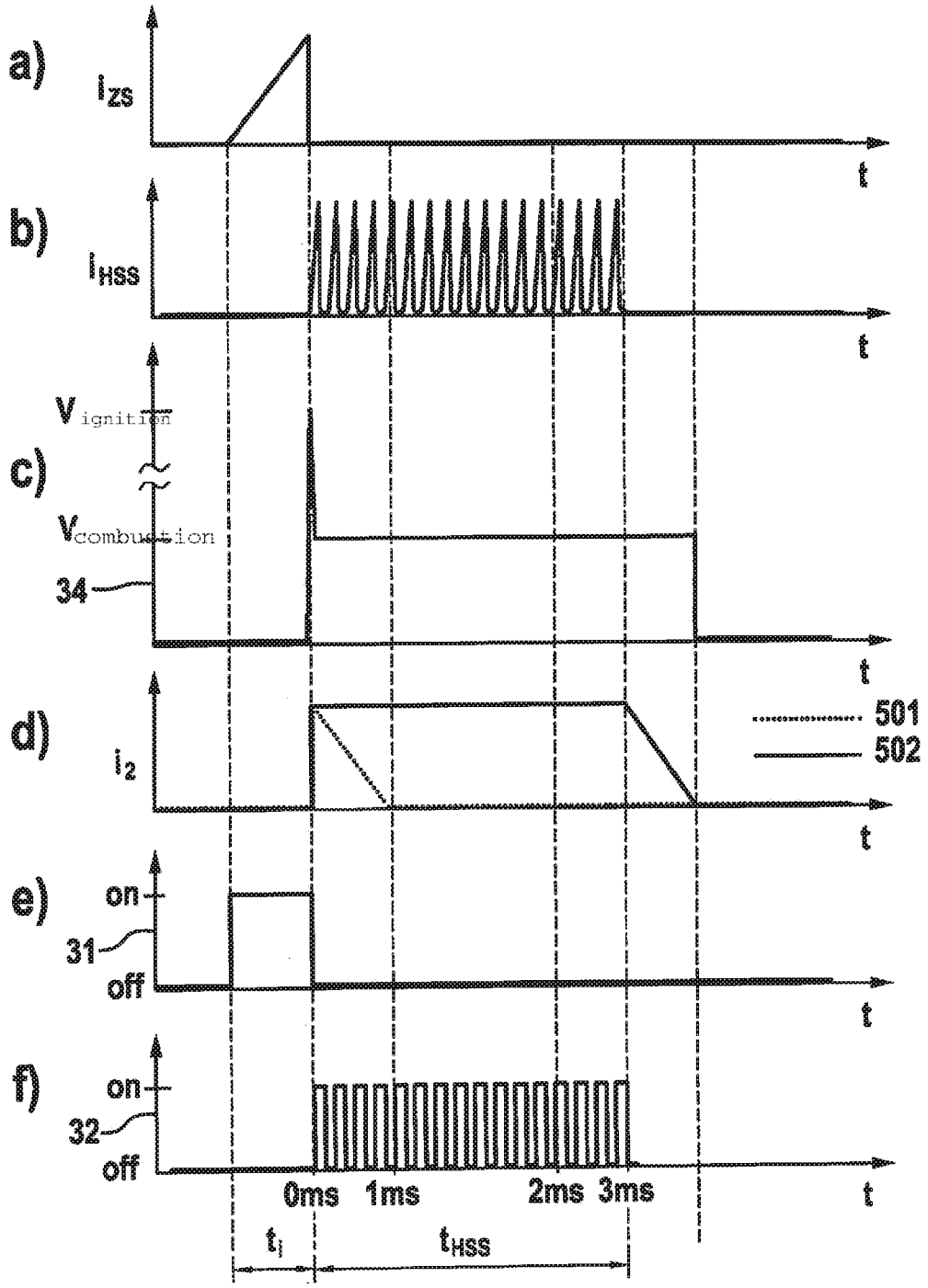
FIG. 2 shows time diagrams for electrical parameters as they may occur during operation of the ignition system depicted in FIG. 1.

FIG. 2 shows time diagrams for a) ignition coil current $i_{zs}$, b) associated bypass current $i_{HSS}$, c) the voltage on the output side across spark gap 6, d) secondary coil current $i_2$ for the ignition system depicted in FIG. 1 without (501) and with (502) the use of bypass 7, e) switching signal 31 of switch 30, and f) switching signal 32 of switch 27. In particular: Diagram a) shows a short and steep rise in primary coil current $i_{zs}$, which occurs during the time in which switch 30 is in the conductive state ("ON", see diagram 3e). With switch 30 switched off, primary coil current $i_{zs}$ also drops to 0 A. Diagram b) illustrates in addition the current consumption of bypass 7, which arises as a result of pulsed activation of switch 27. In practice, clock rates in the range of several 10 kHz have proven to be a reliable switching frequency, in order to achieve corresponding voltages on the one hand and acceptable degrees of efficiency on the other hand. The integral multiples of 10,000 Hz in the range of between 10 kHz and 100 kHz are cited by way of example as possible range limits. To regulate the output delivered to the spark gap, a, in particular, stepless control of the pulse-pause ratio of signal 32 is recommended for generating a corresponding output signal. Diagram c) shows profile 34 of the voltage occurring at spark gap 6 during the operation according to the present invention. Diagram d) shows the profiles of secondary coil current $i_2$.

Once primary coil current $i_{zs}$ results in 0 A due to an opening of switch 30, and the magnetic energy stored in the step-up transformer is discharged as a result in the form of an electrical arc across spark gap 6, a secondary coil current $i_2$ occurs, which rapidly drops toward 0 without bypass (501). In contrast to this, an essentially constant secondary coil current $i_2$ (502) is driven across spark gap 6 by a pulsed activation (see diagram f, switching signal 32) of switch 27, secondary current $i_2$ being a function of the burning voltage at spark gap 6 and, for the sake of simplicity, a constant burning voltage being assumed here. Only after interruption of bypass 7 by opening switch 27, does secondary coil current $i_2$ then also drop toward 0 A. It is apparent from diagram d) that the descending flank is delayed by the use of bypass 7. The entire period of time during which the bypass is used, is characterized as $t_{HSS}$ and the period of time during which energy is passed into step-up transformer 2 on the primary side, as $t_i$. The starting time of $t_{HSS}$ as opposed to $t_i$ may be variably selected. In addition, it is also possible to increase the voltage supplied by the electrical energy source via an additional DC-DC converter (not depicted), before this voltage is further processed in bypass 7. It is noted that specific designs are a function of many external boundary conditions inherent to circuitry. The involved person skilled in the art is not presented with any unreasonable difficulties in undertaking the dimensionings suitable for this purpose and for the boundary conditions that should be taken into consideration.

Figure 3:
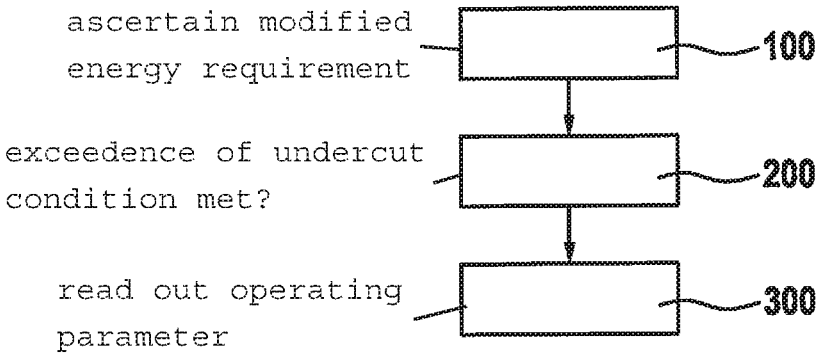
FIG. 3 shows a flow chart, illustrating steps of one exemplary embodiment of the method according to the present invention.

FIG. 3 shows a flow chart, illustrating the steps of one exemplary embodiment of the method according to the present invention. In this embodiment, a modified energy requirement for an ignition spark to be maintained with the aid of the bypass is ascertained in step 100. During the course thereof, a measurement of an electrical operating variable of the ignition system (in particular, the ignition spark gap) is carried out, and the ascertained value is compared with a stored reference in step 200. An operating parameter associated with the reference, which, for example may be stored as an operating variable class assigned to the measured values is read out and in step 300, the working mode of the bypass is modified in accordance with the updated operating parameter. For example, the parameter may indicate a change of a switching frequency during the operation of the boost converter as a bypass. As a result of the modified switching frequency, a modified voltage is delivered through the bypass to the spark gap, so that either a breakaway of the spark or an increased electrode erosion may be avoided.

According to one exemplary embodiment, the modified energy requirement is ascertained by ascertaining an electrical parameter and/or a change of this parameter and/or a change speed of this parameter in step 100. The electrical parameter is, for example, a current of the ignition spark and/or a voltage characterizing a voltage of the ignition spark. It is also ascertained in step 200 whether an exceedance condition and/or an undercut condition is met, by checking whether a comparison variable exceeds a predetermined upper threshold value and/or undercuts a predetermined lower threshold value. If the comparison variable exceeds the predetermined upper threshold value, the exceedance condition is met. If the comparison variable undercuts the predetermined lower threshold value, the undercut condition is met. Here, the comparison variable may be the ascertained parameter or the change of the ascertained parameter or the change speed of the ascertained parameter. The upper threshold value and/or the lower threshold value is dynamically or statically stored in a memory, for example.

The working mode of the bypass is modified according to the exemplary embodiment in step 300 by reducing the power output or a variable characterizing the power output if the exceedance condition is met. If, in contrast, the undercut condition is met, a spark breakaway is imminent and the power output or the variable characterizing the power output is increased. The power output of the bypass or the variable characterizing the power output of the bypass may be reduced or increased in predefinable steps or continuously, specifically based on a target value or a previous value. The values of the individual steps for reducing or increasing the power output are dynamically or statically stored in a memory, for example.

The steps for ascertaining the modified energy requirement and the steps for modifying the working mode of bypass 7 form a control. This control is designed, for example, as a non-linear control, in particular, as a two-point control or three-point control. However, a continuous control may also be provided, in particular, a control having P- and/or I- and or D-control elements.

The power output or the variable characterizing the power output in this case is increased or decreased by modifying the clocked activation of switch 27 of bypass 7.

A computer program may be provided, which is configured to carry out all described steps of the method according to the present invention. The computer program in this case is stored on a memory medium. As an alternative to the computer program, the method according to the present invention may be controlled by an electrical circuit provided in the ignition system, an analog circuit, an ASIC or a microcontroller, which is configured to carry out all described steps of the method according to the present invention.

Even though the aspects and advantageous specific embodiments according to the present invention have been described in detail with reference to exemplary embodiments explained in conjunction with the figures, modifications and combinations of features of the depicted exemplary embodiments are possible for those skilled in the art, without departing from the scope of the present invention.

What is claimed is:

1. A method for operating an ignition system for an internal combustion engine, the ignition system including a primary voltage generator and a bypass, for maintaining an ignition spark generated with the aid of the primary voltage generator, the method comprising:

ascertaining a modified energy requirement for the ignition spark; and modifying, based on the ascertained modified energy requirement, a working mode of the bypass, the modifying including one of shortening or lengthening a supply of energy from the bypass for maintaining the ignition spark, the shortening or lengthening being in response to a modified operating state of the internal combustion engine.

2. The method as recited in claim 1, wherein the bypass is a boost converter.

3. The method as recited in claim 1, wherein the ascertaining of the modified energy requirement includes measuring at least one of a current of the ignition spark and a voltage corresponding to a voltage of the ignition spark.

4. The method as recited in claim 1, wherein the ascertaining of the modified energy requirement includes comparing a measured electrical parameter of an ignition spark with an assigned reference.

5. The method as recited in claim 4, further comprising:

classifying the electrical parameter, and modifying the working mode of the bypass as a function of a parameter assigned to the class.

6. The method as recited in claim 1, wherein the ascertaining of the modified energy requirement includes:

ascertaining at least one of an electrical parameter, a change of the parameter, and a change speed of the parameter, the electrical parameter being at least one of a current of the ignition spark and a voltage characterizing a voltage of the ignition spark; and ascertaining whether an exceedance condition or an undercut condition is met by ascertaining whether a comparison variable exceeds a predetermined upper threshold value or undercuts a predetermined lower threshold value, the comparison variable being one of the one of the ascertained parameter, the change of the ascertained parameter, or the change speed of the ascertained parameter.

7. The method as recited in claim 6, wherein the modifying of the working mode of the bypass includes:

adjusting a power output of the bypass or of a variable characterizing the power output of the bypass, if the exceedance condition or undercut condition is met.

8. The method as recited in claim 7, wherein the modifying of the working mode of the bypass includes one of:

decreasing the power output of the bypass or a variable characterizing the power output of the bypass, if the exceedance condition is met; or increasing the power output of the bypass or a variable characterizing the power output of the bypass if the undercut condition is met.

9. The method as recited in claim 8, wherein the decreasing or increasing of the power output of the bypass or of the variable characterizing the power output of the bypass takes place in predefinable steps or continuously.

10. The method as recited in claim 9, wherein the power output of the bypass or the variable characterizing the power output of the bypass is increased or decreased by modifying a clocked activation of a switch of the bypass.

11. A machine-readable memory medium storing a computer program for operating an ignition system for an internal combustion engine, the ignition system including a primary voltage generator and a bypass, for maintaining an ignition spark generated with the aid of the primary voltage generator, the computer program, when executed by a control unit, causing the control unit to perform:

ascertaining a modified energy requirement for the ignition spark; and modifying, based on the ascertained modified energy requirement, a working mode of the bypass, the modifying including one of shortening or lengthening a supply of energy from the bypass for maintaining the ignition spark, the shortening or lengthening being in response to a modified operating state of the internal combustion engine.

12. An ignition system for an internal combustion engine, the ignition system including a primary voltage generator and a bypass, for maintaining an ignition spark generated with the aid of the primary voltage generator, the ignition system configured to:

ascertain a modified energy requirement for the ignition spark; and modify, based on the ascertained modified energy requirement, a working mode of the bypass, the modifying including one of shortening or lengthening a supply of energy from the bypass for maintaining the ignition spark, the shortening or lengthening being in response to a modified operating state of the internal combustion engine.

13. The method as recited in claim 1, wherein the modified operating state is a modified speed of the internal combustion engine.

14. The machine-readable memory medium as recited in claim 11, wherein the modified operating state is a modified speed of the internal combustion engine.

15. The ignition system as recited in claim 12, wherein the modified operating state is a modified speed of the internal combustion engine.

16. The method as recited in claim 1, wherein the shortening or lengthening of the supply of energy from the bypass is a shortening or lengthening of a time duration of the supply of energy from the bypass.

17. The machine-readable memory medium as recited in claim 11, wherein the shortening or lengthening of the supply of energy from the bypass is a shortening or lengthening of a time duration of the supply of energy from the bypass.

18. The ignition system as recited in claim 12, wherein the shortening or lengthening of the supply of energy from the bypass is a shortening or lengthening of a time duration of the supply of energy from the bypass.

* * * * *